US006278473B1

(12) United States Patent
Veigl

(10) Patent No.: US 6,278,473 B1
(45) Date of Patent: Aug. 21, 2001

(54) FACSIMILE DEVICE HAVING A THERMO-TRANSFER FOIL FOR PRINTING A PAPER SHEET AND HAVING MEANS FOR REDUCING THE FOIL CONSUMPTION

(75) Inventor: Johann Veigl, Vienna (AT)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/198,931

(22) Filed: Nov. 24, 1998

(30) Foreign Application Priority Data

Dec. 1, 1997 (EP) ..... 97890241

(51) Int. Cl.[7] ..... B41J 2/325; B41J 17/02

(52) U.S. Cl. ..... 347/213; 347/215

(58) Field of Search ..... 347/214, 215, 347/213, 218, 217; 400/208, 231; 271/121

(56) References Cited

U.S. PATENT DOCUMENTS 5,451,996 * 9/1995 Awai et al. ..... 347/214
6,022,015 * 2/2000 Matsumoto ..... 271/121
6,082,912 * 7/2000 Shimuzu et al. ..... 347/218

* cited by examiner

*Primary Examiner*—N. Le
*Assistant Examiner*—K. Feggins

(57) ABSTRACT

Facsimile device having a thermo-transfer foil for printing a paper sheet and having a device for reducing the foil consumption. A facsimile device (1) having paper-supply holding mechanism (2) for holding at least one sheet of paper (3) and having thermal printing device (14) for printing the sheet of paper (3) by a device of a thermo-transfer foil (7) includes additional mechanism (36) by which an unnecessary consumption of thermo-transfer foil (7) can be avoided.

8 Claims, 2 Drawing Sheets

FACSIMILE DEVICE HAVING A THERMO-TRANSFER FOIL FOR PRINTING A PAPER SHEET AND HAVING MEANS FOR REDUCING THE FOIL CONSUMPTION

BACKGROUND OF THE INVENTION

The invention relates to a facsimile device which includes the means specified hereinafter, namely paper-supply holding means which serve for holding at least one paper sheet, sheet withdrawal means which serve for withdrawing only one paper sheet at a time from the paper-supply holding means and which include a rotationally drivable sheet withdrawal roller, a thermo-transfer foil which can be fed from a supply roll to a drivable take-up roll, thermal printing means with the aid of which ink particles can be transferred from the thermo-transfer foil to a paper sheet withdrawn from the paper-supply holding means in order to form a printed image, during which the thermo-transfer foil and the paper sheet can be driven synchronously, drive means which serve for synchronously driving the thermo-transfer foil and a paper sheet withdrawn from the paper-supply holding means and which include a rotationally drivable drive roller, at least one motor for driving the drive roller and for driving the sheet withdrawal roller, a first drive transmission via which the drive roller can be driven by a motor, a second drive transmission via which the sheet withdrawal roller can be driven via a motor, and control means for the at least one motor, by which control means driving of a motor shaft of a motor in a first direction of rotation, for synchronously driving a paper sheet and the thermo-transfer foil, can be activated.

Such a facsimile device of the type defined in the opening paragraph is commercially available from the Applicant in the form of a facsimile apparatus under the type designation PPF 30 and is consequently known.

In this known apparatus the drive roller drives the thermo-transfer foil during the phase of operation in which a paper sheet is withdrawn from the paper-supply holding means and the subsequent transport of this paper sheet to the drive roller, although the thermo-transfer foil is not used for printing in this phase of operation of the known apparatus, which means that the thermo-transfer foil is driven unnecessarily in this phase of operation of the apparatus, which leads to an unnecessary foil consumption. As such a thermo-transfer foil is comparatively expensive such an unnecessary foil consumption represents an undesirable loss, which is to be avoided.

BRIEF SUMMARY OF THE INVENTION

It is an object of the invention to preclude or at least substantially mitigate the afore-mentioned problem and to provide an improved facsimile device of the type defined in the opening paragraph, in which an unnecessary foil consumption is prevented at least largely.

According to the invention, in order to achieve the afore-mentioned object in a facsimile device of the type defined in the opening paragraph, there have been provided additional means with the aid of which driving of the thermo-transfer foil by means of the drive roller can be inhibited in the absence of a paper sheet at the drive roller. Owing to the measures in accordance with the invention it is achieved by simple-to-realize additional means that an unnecessary foil consumption of a thermo-transfer foil used in a facsimile device in accordance with the invention can be avoided since the measures in accordance with the invention guarantee that, in the phase of operation of the facsimile device in accordance with the invention in which a paper sheet is withdrawn from the paper supply holding means and is being transferred to the drive roller, driving of the facsimile device by means of the drive roller can be inhibited at least for the greater part and, advantageously, also wholly.

In a facsimile device in accordance with the invention, in which there has been provided only one motor for driving the drive roller and the sheet withdrawal roller, and in which there has been provided a freewheel device of the type commonly called a lost motion mechanism in the second drive transmission before the sheet withdrawal roller, which freewheel device forms a drive transmission for each of its two directions of rotation and in the case of a reversal of the d direction of rotation the does not a transmit a driving torque for a given freewheel interval and does not again form a drive transmission until after expire of this freewheel interval—as is known per se from the known facsimile apparatus having the type designation PPF 30—it has proved to be very advantageous if, in addition, if the device has one motor only for driving the drive roller and the sheet withdrawal roller, the first drive transmission includes a lost motion mechanism, the second drive transmission includes a unidirectional drive device for driving only in the first direction of transmission, and the motor is driven in a second direction for a period of time less than that corresponding to movement through the full interval of the lost motion mechanism. Thus, it is achieved that the additional means only include the further lost motion mechanism; and the unidirectional device, as a result of which an unnecessary foil consumption can be avoided with minimal and, consequently, low-cost means.

In a facsimile device in accordance with the invention having the characteristic features defined above, the one motor shaft can be driven in the second direction of rotation during such a driving interval that the further freewheel device is also driven for a slightly longer time than the further freewheel interval. However, driving for a shorter time has; proved to be particularly advantageous because this prevents the thermo-transfer foil from being driven in a direction opposite to its normal transport direction.

The afore-mentioned aspects as well as further aspects of the invention will be apparent from the embodiment described hereinafter by way of example and will be elucidated with reference to this embodiment.

BRIEF DESCRIPTION OF THE SEVERAL VEIWES OF THE DRAWINGS

The invention will now be described in more detail with reference to an embodiment shown in the drawings and given by way of example, but to which the invention is not limited.

DETAILED DESCRIPTION OF THE INVENTION

Figure 1:
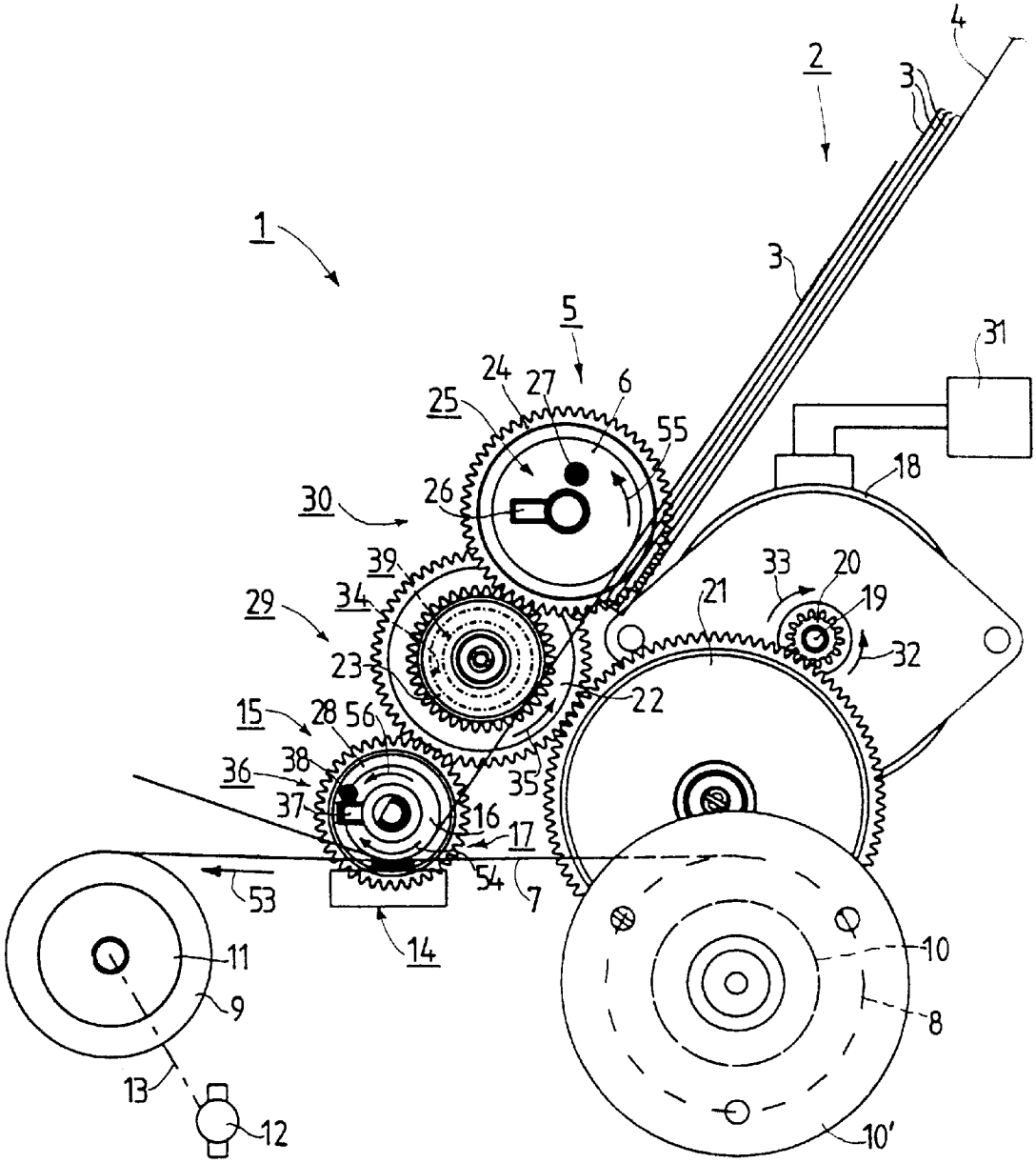
FIG. 1 is a highly diagrammatic representation of a part of a facsimile device in accordance with the invention.

FIG. 1 shows a relevant part of a facsimile device 1 constructed as a facsimile apparatus which can be placed onto a table top during operation. Hereinafter, the facsimile device 1 will be referred to briefly as the device 1. The device 1 includes means of which FIG. 1 shows only those which are relevant in the present context and which will be described in more detail hereinafter.

The device 1 includes paper-supply holding means 2 for holding at least one paper sheet 3. The paper-supply holding means 2 essentially comprise a tray 4, into which a plurality of paper sheets 3 can be loaded and which, as is common practice, has corner separators, not shown, at its lower end in FIG. 1.

The device 1 further includes sheet withdrawal means 5 for withdrawing each time one paper sheet 3, namely the free uppermost paper sheet 3, from the paper-supply holding means 2. The sheet withdrawal means 5 comprise a rotationally drivable sheet withdrawal roller 6. The drive means for the sheet withdrawal roller 6 and the manner in which the sheet withdrawal roller 6 is driven will be described in detail hereinafter.

The device 1 further includes a thermo-transfer foil 7, which can be fed from a supply roll 8 to a drivable take-up roll 9. The supply roll 8 has been wound onto a cylindrical, essentially tubular supply hub 10 having a flange 10' at each of its axial ends. The take-up roll 9 has been wound onto a take-up hub 11 of a similar construction but without any flanges. The thermo-transfer foil 7 can be loaded into the device 1 by hand, a new thermo-transfer foil 7 which has not been used before being wholly wound on the supply hub 10 during such loading. After the thermo-transfer foil 7 has been loaded into the device 1 the foil can be unwound from the supply roll 8 and can at the same time be wound onto the take-up roll 9, the take-up reel 9 being rotationally driven by means of a hub-drive motor 12, which drives the take-up hub 11 via a drive transmission 13 indicated by means of a dash-dot line. With respect to the drive transmission 13 it is to be noted that it includes a friction coupling to allow the take-up hub 11 to be driven with a torque which is independent of the torque produced by the hub-drive motor 12.

The device 1 further includes thermal printing means 14. The thermal printing means essentially comprise a so-called thermal printing head, which in known manner comprises a plurality of adjacent thermal printing elements which are juxtaposed in the sheet width direction of a paper sheet 3. The thermal printing means 14 are mounted in the device 1 so as to be movable, the thermal printing means cooperating with spring means, not shown, with which the thermal printing means can be pressed against the thermo-transfer foil 7 and the thermo-transfer foil 7 against a paper sheet 3 which cooperates with the thermo-transfer foil 7. With the aid of the thermal printing means 14 ink particles can be transferred from the thermo-transfer foil 7 to a paper sheet 3 withdrawn from the paper-supply holding means 2 in order to form a printed image on a paper sheet 3. During such a formation of a printed image by transferring ink particles from the thermo-transfer foil 7 to a paper sheet 3 the thermo-transfer foil 7 and the relevant paper sheet 3 can be driven synchronously.

For synchronously driving the thermo-transfer foil 7 and a paper sheet 3 withdrawn from the paper-supply holding means 2 the device 1 comprises drive means 15. The drive means 15 include a rotationally drivable drive roller 16. The drive roller 16 is arranged in such an opposite relationship to the thermal printing means 14 that the thermo-transfer foil 7 can be pressed against the drive roller 16 with the aid of the thermal printing means 14, which are movable towards the drive roller 16 with the aid of the afore-mentioned spring means, which is not shown in FIG. 1 because this is also common practice, as a result of which—as soon as a paper sheet 3 has been withdrawn from the paper-supply holding means 2 and has been moved into the wedge-shape entry area 17 between the drive roller 16 and the thermal printing means 14—a paper sheet 3 is engaged by the drive roller 16 and is pulled between the drive roller 16 and the thermo-transfer foil 7. Subsequently, both the respective paper sheet 3 and the thermo-transfer foil 7 are driven synchronously, i.e. transported at the same time, by means of the drive roller 16, a dotwise transfer of ink particles from the thermo-transfer foil to the paper sheet 3 then being possible by means of the thermal printing means 14 by a suitable heating of the thermal elements of these thermal printing means and a resulting dotwise heating of the thermo-transfer foil. The drive means for the drive roller 16 and the manner in which the drive roller 16 is driven will be described in detail hereinafter.

The device 1 further includes a motor 18, which serves for driving the drive roller 16 and the sheet withdrawal roller 6. The motor shaft 19 of the motor 18 carries a drive pinion 20, which is in mesh with a toothed wheel 21. A first toothed intermediate wheel 22 is in mesh with the toothed wheel 21. A second toothed intermediate wheel 23 is coaxial with the first toothed intermediate wheel 22 and can be driven by the first toothed intermediate wheel 22, which will be described in detail hereinafter.

A first toothed drive wheel 24 meshes with the second toothed intermediate wheel 23 and is coaxial with the sheet withdrawal roller 6. A freewheel device 25 is arranged between the first toothed drive wheel 24 and the sheet withdrawal roller 6 and essentially comprises a substantially radial coupling projection 26 connected to the first toothed drive wheel 24 and a substantially axial coupling pin 27 connected to the sheet withdrawal roller 6. Such freewheel devices (lost motion mechanisms) have been known since long. The freewheel device 25 forms a drive transmission for each of its two directions of rotation. In the case of a reversal of the direction of rotation the freewheel device 25 does not a transmit a driving torque for a given freewheel interval of time, the freewheel interval of time being dependent on the time it takes until the coupling projection 26 and the coupling pin 27 again engage with one another after these two freewheel elements have become disengaged upon a reversal of the direction of rotation. The freewheel device 25 does not restore the drive transmission until after this freewheel interval of time has expired upon a reversal of the direction of rotation.

A second toothed drive wheel 28 is in mesh with the first toothed intermediate wheel 22. The second toothed drive wheel 28 is coaxial with the drive roller 16. The drive roller 16 can be driven by means of the second toothed drive wheel 28, as will be described in detail hereinafter.

In the device 1 the motor shaft 19, the drive pinion 20, the toothed wheel 21, the first toothed intermediate wheel 22 and the second toothed drive wheel 28 form a first drive transmission 29 between the motor 18 and the drive roller 16, thus enabling the drive roller 16 to be driven by the motor 18 via this first drive transmission 29.

In the device 1 the motor shaft 19, the drive pinion 20, the toothed wheel 21, the first toothed intermediate wheel 22, the second toothed intermediate wheel 23 and the first toothed drive wheel 24 form a second drive transmission 30 between the motor 18 and the sheet withdrawal roller 6, thus enabling the sheet withdrawal roller 6 to be driven by the motor 18 via this second drive transmission 30. The freewheel device 25 is arranged in the second drive transmission 30 before the sheet withdrawal roller 6 and may thus be considered to belong to the second drive transmission 30.

The device 1 further includes electrical or electronic control means 31 for the motor 13. The control means 31 essentially comprise a microcomputer and a motor supply circuit, which elements are not shown separately in FIG. 1 because such a construction has been known since long and is also employed in the apparatus which is commercially available from the Applicant, as mentioned in the introductory part. The control means 31 can activate driving of the motor shaft 19 of the motor 18 in a first direction of rotation, as is indicated by an arrow 32 in FIG. 1. The control means 31 can advantageously activate driving of the motor shaft 19 of the motor 18 in a second direction of rotation opposite to the first direction of rotation, as is indicated by an arrow 33 in FIG. 1.

Advantageously, the device 1 includes a unidirectional device 34 in the second drive transmission 30 before the freewheel device 25, which unidirectional device is shown only diagrammatically in FIG. 1. The unidirectional device 34 forms a drive transmission for a given direction of rotation whereas the unidirectional device 34 does not form a drive transmission in the opposite direction of rotation. In the device 1 the unidirectional device 34 forms a drive transmission when the toothed intermediate wheel 22 is driven as indicated by the arrow 35, as a result of which the second toothed intermediate wheel 23 is then also rotated as indicated by the arrow 35.

Advantageously, the device 1 also includes a further freewheel device (lost motion mechanism) 36 in the first drive transmission 29 before the drive roller 16. The further freewheel device is in principle of the same construction as the freewheel device 25. Essentially, it comprises a further coupling projection 37 and a further coupling pin 38. The further coupling projection 37 is connected to the second toothed drive wheel 28. The further coupling pin 38 is consequently connected to the drive roller 16. The further freewheel device 36 forms a drive transmission for each of its two directions of rotation. In the case of a reversal of the direction of rotation the further freewheel device 36 does not transmit any driving torque for a given further freewheel interval of time but this further freewheel device 36 forms a drive transmission again only after this freewheel interval has expired. Owing to different diameter ratios and different numbers of revolution the freewheel interval of the freewheel device 25 and the further freewheel interval of the further freewheel device 36 have different values.

Figure 2:
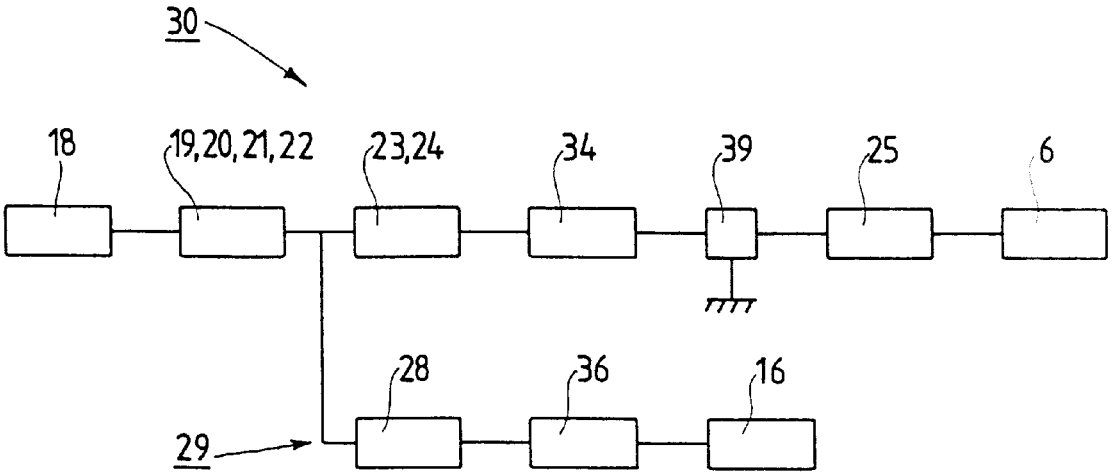
FIG. 2 is an even more diagrammatic representation—in the form of mechanical blocks—which shows essentially the part of the facsimile device shown in FIG. 1

It is to be noted that in the device 1 brake means 39 are included in the second drive transmission 30 between the unidirectional device 34 and the freewheel device 25, which brake means serve for braking a driving element of the unidirectional device 34. The brake means 39 as well as the unidirectional device 34 are shown only diagrammatically in FIGS. 1 and 2.

Figure 3:
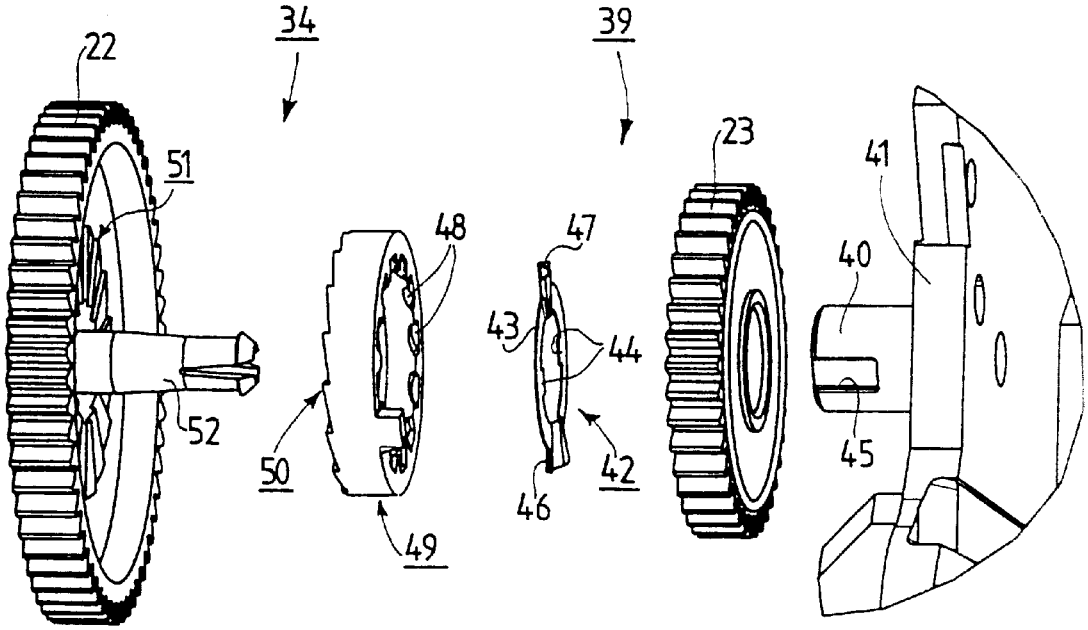
FIG. 3 is an exploded view of a part of the facsimile device shown in FIGS. 1 and 2, part includes a unidirectional device and subsequent brake means.

For the unidirectional device 34 and the brake means 39 reference is made to FIG. 3. FIG. 3 shows the actual construction of the unidirectional device 34 and the brake means 35.

FIG. 3 shows the first toothed intermediate wheel 22 and the second toothed intermediate wheel 23. The second toothed intermediate wheel 23 can be fitted onto a hollow cylindrical trunnion 40 which projects laterally from a stationary wall 41 in the device 1. After the second toothed intermediate wheel 23 has been mounted onto the trunnion 40 a brake spring 42 can be fitted onto the trunnion 40. The brake spring 42 has a ring portion 43 from which two mutually aligned locking projections 44 extend, which projections engage in corresponding recesses in the trunnion 40, of which only one recess 45 is visible in FIG. 3. The brake spring 42 further has two arms 46 and 47 which project radially outward from the ring portion 43 and with which the brake spring engages in appropriate recesses formed in a driving member 49 of the unidirectional device 34.

The driving member 49 of the unidirectional device 34 is also substantially ring-shaped. On its radial wall which faces the first toothed intermediate wheel 22 the driving member 49 has a saw-tooth-like toothed portion 50 which serves and is adapted to cooperate with a saw-tooth-like complementary toothed portion 51 on the first toothed intermediate wheel 22. The driving member 49 of the toothed intermediate wheel 34 can be fitted onto a mandrel 52 of the first toothed intermediate wheel 22, after which the mandrel 52 can be introduced into the hollow cylindrical trunnion 40.

Thus, the unidirectional device 34 is essentially formed by the sawtoothlike complementary toothed portion 51 on the first toothed intermediate wheel 22 and by the saw-tooth-like toothed portion 50 on the driving member 49 of the unidirectional device 34. The brake means 35 are essentially formed by the brake spring 42 which acts upon the second toothed intermediate wheel 23 with an axially directed spring force and which is locked in rotation to the driving member 49 with the arms 47 and 47 and thereby brakes the driving member 49 of the unidirectional device 34.

The operation of the device 1 will now be described in more detail hereinafter but only those measures which are relevant here will be elucidated.

It is assumed that the control means 31 have controlled and subsequently control the motor 18 in such a manner that—as is shown in FIG. 1—the motor shaft 19 is driven in the first direction of rotation 32, a paper sheet 3 withdrawn from the paper-supply holding means 2 and the thermo-transfer foil 7 then being driven synchronously in the direction indicated by the arrow 53 with the aid of the drive roller 16 and with the aid of the thermal printing means 14, which press the paper sheet 3 and the thermo-transfer foil 7 resiliently onto the drive roller 16. The motor 18 then rotates the drive roller 16 in the direction indicated by the arrow 54 and sheet withdrawal roller 6 in the direction indicated by the arrow 55.

The two drive transmissions 29 and 30 are adapted to one another in such a manner that the speed of the drive roller 16 at the location of its circumference is slightly higher than the circumferential speed of the sheet withdrawal roller 6. As a result of this, the paper sheet 3 which is driven by the drive roller 16 is withdrawn from the paper-supply holding means 2 with such a high speed that this paper sheet 3 drives the sheet withdrawal roller 6 more rapidly than the first toothed drive wheel 24. This now results in the coupling pin 27 of the freewheel device 25, which pin is connected to the sheet withdrawal roller 6, being disengaged from the coupling projection 26 of the freewheel device 25, which projection is connected to the first toothed wheel 24, and the coupling pin 27 being moved relative to the coupling projection 26 in the direction indicated by the arrow 55. This movement of the coupling pin 27 relative to the coupling projection 26 of the freewheel device 25 ceases when the end of a paper sheet 3 withdrawn from the paper-supply holding means 2 has passed the sheet withdrawal roller 6.

Subsequently, the coupling pin 27 is moved relative to the coupling projection 26 in a direction opposite to that indicated by the arrow but this does not have any effect as long as the coupling pin 27 and the coupling projection 26 have not again come into engagement with one another. During this movement of the coupling pin 27 relative to the coupling projection 26 in a direction opposite to that indicated by the arrow 55 the withdrawn paper sheet 3 is subsequently driven jointly and in synchronism with the thermo-transfer foil 7. During this synchronous driving the thermal printing means 14 effect printing by a transfer of ink particles from the thermo-transfer foil 7 to the paper sheet 3. When the end of the paper sheet 3 has passed the thermal printing means 14 the operation of printing this paper sheet 3 is terminated.

In the device 1, before another paper sheet 3 is extracted from the paper-supply holding means 2 and this further paper sheet 3 is subsequently fed to the drive roller 16, the control means 31 for the motor 18 cause the direction of rotation of the motor shaft 19 to be reversed and the motor shaft 19 to be subsequently driven in the second direction of rotation 33, which is opposed to the first direction of rotation 32 for the synchronous drive of a paper sheet 3 and the thermo-transfer foil 7, for such a driving interval that the further freewheel device 36 is driven for a slightly shorter time than its freewheel interval of time. When the reversal of the direction of rotation of the motor shaft 19 has been activated the unidirectional device 34 in the second drive transmission 30 ensures substantially without any delay that the drive transmission to the second toothed intermediate wheel 23 and thus to the first toothed drive wheel 24 and the freewheel device 25 as well as the sheet withdrawal roller 6 is interrupted. As a result of the reversal of the direction of rotation of the motor shaft 19 and the subsequent driving of the motor shaft 19 in the second direction of rotation 33, the second toothed drive wheel 28 is driven via the toothed wheel 21 and the first toothed intermediate wheel 22 in the direction indicated by the arrow 56. This causes the further freewheel device 36 to act in such a manner that it does not form a drive transmission to the drive roller for at least its further freewheel interval of time, which is effected because the further coupling projection 37 is disengaged from the further coupling pin 38 and subsequently the further coupling projection 37 is moved relative to the further coupling pin 38 in the direction indicated by the arrow 56. This relative movement between the further coupling projection 37 and the further coupling pin 38 is terminated briefly before the end of the further freewheel interval is reached in that the control means 31 again effect a reversal of the direction of rotation of the motor shaft 19 of the motor 18.

As a result of this new reversal of the direction of rotation of the motor shaft 19 of the motor 18 the unidirectional device 34 immediately establish a drive transmission to the sheet withdrawal roller 6, so that a following paper sheet 3 is withdrawn from the paper-supply holding means in a direction towards the drive roller 16. As this following paper sheet 3 is fed from the paper-supply holding means 2 to the drive roller 16 with the aid of the sheet withdrawal roller 6 the further coupling projection 37 of the further freewheel device 36 is moved relative to the further coupling pin 38 of the further freewheel device 36 in the direction indicated by the arrow 54. The motor 18 then drives the further coupling projection 37 via the second toothed drive wheel 28 in the direction indicated by the arrow 54 but does not drive the further coupling pin 38. As a result of this, the drive roller 16, to which the coupling pin 38 is connected, is in principle not driven for the duration of the further freewheel interval of time of the further freewheel device 36, which has the distinct advantage that the thermo-transfer foil 7 is not driven during this time interval. Thus, an unnecessary consumption of thermo-transfer foil 7 is avoided, which is advantageous. It is not until the paper sheet 3 which has previously been fed out of the paper-supply holding means 2 has reached the drive roller 16 and entered the wedge-shaped area 17 between the drive roller 16 and the thermal printing means 14 with its leading end that the further coupling projection 37 of the further freewheel device 36 again positively engages with the further coupling pin 38 of the further freewheel device 36, as a result of which—after expiry of the further freewheel interval of time—the drive roller 16 is also driven and subsequently ensures that the paper sheet 3 and the thermo-transfer foil 7 are driven synchronously.

The invention is not limited to the embodiment described hereinbefore by way of example. It is to be noted particularly that for the construction of the freewheel devices and the unidirectional device as well as the brake means for the driving member of the unidirectional device a multitude of variants are possible within the scope of the state of the art. Moreover, the drive roller and the sheet withdrawal roller may each be driven by a separate motor via a separate drive transmission each, in which case the sheet withdrawal roller can be arranged so as to be movable in such a manner that—after withdrawal of a paper sheet from the paper-supply holding means and the subsequent transport of this paper sheet to the drive roller—it can be lifted off this paper sheet and, consequently, can no longer have a driving influence on this paper sheet.

What is claimed is:

1. A facsimile device (1) comprising:

paper-supply holding means (2) for holding at least one paper sheet (3), sheet withdrawal means (5), including a rotationally drivable sheet withdrawal roller (6), for withdrawing only one paper sheet (3) at a time from the paper-supply holding means, an ink transfer foil (7) fed from a supply roll (8) to a drivable take-up roll (9), drive means (15), including a rotationally drivable drive roller (16), for synchronously driving the ink transfer foil and a sheet withdrawn from the paper-supply holding means in a same direction, printing means (14) for transferring ink particles from the ink transfer foil to said paper sheet withdrawn from the paper-supply holding means and being driven synchronously with said ink transfer foil, to form a printed image, motor means, comprising at least one motor (18), for driving the drive roller and for driving the sheet withdrawal roller, a first drive transmission (29) by which the drive roller is driven by said motor means, a second drive transmission (30) by which the sheet withdrawal roller is driven by said motor means, and control means for the motor means, for activating driving in a first direction of rotation for synchronously driving the ink transfer foil and said sheet withdrawn from the paper-supply holding means, characterized in that the device further comprises means for inhibiting driving of the ink transfer foil by the drive roller (16) during an initial portion of the withdrawal of the sheet from the paper-supply holding means.

2. A device as claimed in claim 1, wherein said motor means includes one motor only, and characterized in that the first drive transmission comprises a lost motion mechanism which forms a drive transmission for said first direction of rotation of said motor means, and upon reversal of the direction of rotation from said first direction does not transmit a driving torque for a lost motion interval, and upon reversal to said first direction forms a drive transmission again after movement through said lost motion interval.

3. A device as claimed in claim 2, characterized in that said second drive transmission includes a unidirectional device (34) which forms a drive transmission for a given direction of rotation (35) and does not form a drive transmission in the opposite direction of transmission.

4. A device as claimed in claim 2, characterized in that said second drive transmission includes a lost motion mechanism which forms a drive transmission between a driving wheel and said sheet withdrawal roller during an initial portion of the withdrawal of the sheet from the paper-supply holding means, and permits rotation of said sheet withdrawal roller at a higher speed than said driving wheel during synchronous driving of the ink transfer foil and the paper sheet.

5. A device as claimed in claim 2, characterized in that said control means is constructed such that, before said paper sheet is withdrawn from the paper-supply holding means, said control means causes driving of said motor means in a direction opposite said first direction of rotation while the lost motion mechanism of said first drive mechanism moves through said lost motion interval.

6. A device as claimed in claim 5, characterized in that said second drive transmission includes a second lost motion mechanism which forms a drive transmission between a driving wheel and said sheet withdrawal roller during an initial portion of the withdrawal of the sheet from the paper-supply holding means, and permits rotation of said sheet withdrawal roller at a higher speed than said driving wheel during synchronous driving of the ink transfer foil and the paper sheet.

7. A device as claimed in claim 6, characterized in that said second drive transmission further includes a unidirectional device (34) before the second lost motion mechanism, said unidirectional device forming a drive transmission for said first direction of rotation (35) and not forming a drive transmission in the opposite direction of transmission.

8. A device as claimed in claim 7, characterized in that the second drive transmission (30) includes brake means (39) for braking a driving member (49) of said unidirectional device between the unidirectional device (34) and the second lost motion mechanism.

* * * * *